US006317577B1

(12) United States Patent
Baruch et al.

(10) Patent No.: US 6,317,577 B1
(45) Date of Patent: Nov. 13, 2001

(54) METHOD AND AN IMPROVED WICK ROLLER FOR CONTROLLING THE DISTRIBUTION OF FUSER OIL ON A FUSER SURFACE

(75) Inventors: Susan C. Baruch, Pittsford; Ronald L. Holland, Rochester; Alan R. Priebe, Rochester; David F. Cahill, Rochester, all of NY (US)

(73) Assignee: Heidelberg Digital, L.L.C., Rochester, NY (US)

( * ) Notice: Subject to any disclaimer, the term of this patent is extended or adjusted under 35 U.S.C. 154(b) by 0 days.

(21) Appl. No.: 09/686,705

(22) Filed: Oct. 11, 2000

(51) Int. Cl.[7] ..... G03G 15/20
(52) U.S. Cl. ..... 399/325; 399/320; 430/124
(58) Field of Search ..... 118/60; 399/324, 399/325, 122, 320; 430/124

(56) References Cited

U.S. PATENT DOCUMENTS

| | | | | |
|---|---|---|---|---|
| 4,501,483 | | 2/1985 | Romansky et al. . | |
| 4,908,670 | * | 3/1990 | Ndebi | 399/325 |
| 5,045,889 | * | 9/1991 | Hoover | 399/325 |
| 5,477,316 | | 12/1995 | Morganti et al. . | |
| 5,708,914 | | 1/1998 | Mills et al. | 399/45 |
| 5,732,317 | * | 3/1998 | Orchard, II et al. | 399/325 |
| 5,781,840 | | 7/1998 | Chen et al. | 399/324 |
| 5,805,968 | | 9/1998 | Chatterjee et al. | 399/324 |
| 5,824,416 | | 10/1998 | Chen et al. | 428/422 |
| 5,871,878 | | 2/1999 | Chatterjee et al. | 430/105 |
| 6,096,427 | | 8/2000 | Chen et al. | 428/399 |

* cited by examiner

*Primary Examiner*—Arthur T. Grimley
*Assistant Examiner*—Hoang Ngo
(74) *Attorney, Agent, or Firm*—F. Lindsey Scott

(57) ABSTRACT

A method and apparatus for extending the useful life of a fuser roller having ends, a length greater than a central portion of the fuser roller, the central portion of the fuser roller having ends, and end portions of the fuser roller extending from the ends of the central portion of the fuser roller to the ends of the fuser roller, at least a portion of the fuser roller being coated during operation with a release agent by contact with a wick roller, the wick roller including a porous ceramic wick roller body having ends, a length greater than a central portion of the wick roller, the central portion of the wick roller having ends, a release agent supply line in fluid communication with a central cavity in the wick roller body, a release agent impermeable coating over lengths of the wick roller body between the ends of the wick roller and the ends of the central portion of the wick roller, and a release agent transfer surface over the outside of the wick roller and the release agent impervious coating by positioning openings in the impermeable coating and in fluid communication with the wick roller body and the release agent transfer surface. The method and apparatus are also effective with fuser belt systems.

26 Claims, 4 Drawing Sheets

METHOD AND AN IMPROVED WICK ROLLER FOR CONTROLLING THE DISTRIBUTION OF FUSER OIL ON A FUSER SURFACE

FIELD OF THE INVENTION

This invention relates to a method for controlling the distribution of fuser oil on a fuser surface and for extending the useful life of a fuser roller and preventing deformation of the exterior of the fuser roller by the use of an improved wick roller.

BACKGROUND OF THE INVENTION

In the production of images on paper or other suitable media, referred to herein as paper, fuser surfaces which may comprise fuser rollers or fuser belts are commonly used to complete the copying or image making process, referred to herein as copying. Such fuser rollers are typically heated rollers which have a surface suitable for heating the toner to a desired temperature under pressure supplied by a pressure roller positioned to operably engage the paper between the fuser roller and the pressure roller to enhance, fix or otherwise improve an image on the paper. Fuser belts comprise a belt which may be heated which conveys the paper between a pressure roller and a backup pressure roller.

Such fuser surfaces typically have a length of approximately 15.5 inches, which enables the handing of 14-inch wide paper. Notwithstanding the use of fuser surfaces of this length, most paper processed through most copying machines is 11 inches in width. Accordingly, the middle portion of the fuser surface is used extensively and there is little use of the outside ends of the fuser surface.

To prevent sticking of the toner to the fuser surface, a release agent is typically supplied to the fuser surface by a wick roller. The wick roller may be independently driven or more commonly is driven by contact with the fuser roller or fuser belt. Typically a suitable pressure is applied to the mounts for the wick roller so that it engages the fuser surface with sufficient pressure to rotate the wick roller in response to the movement of the fuser surface. The wick roller deposits a pre-selected quantity of a release agent on the surface of the fuser surface prior to contact with each page of paper. The amount of release agent supplied is selected as that quantity necessary to prevent the toner from sticking to the fuser surface. Typically, release agents may be silicone oils which may contain various additives to facilitate their performance as an anti-sticking agent and are referred to herein as oil.

Since in many instances, the predominant paper size is 11 inch wide paper, many wick rollers have been adapted to oil only the central portion of the fuser surface, i.e., the middle 11 inch section of the fuser roller or fuser belt. This is accomplished by placing an oil impermeable coating over the ends of the length of the wick roller, outside a central section of the wick roller, so that no oil passes through the impervious coating. All of the oil then is released by the wick roller in a central portion of the wick roller, which corresponds, to the central portion of the fuser surface. While this has been effective to distribute the release agent in only the areas where it is needed, over long periods of time it has been observed that the absence of oil on the surface of fuser rollers in the end portions has led to non-uniform shrinking, non-uniform deformation and the like of the end portions. When the fuser roller surface becomes non-uniformly deformed it tends to adversely affect the paper handling ability of the fuser roller. Further if too much release agent is applied to the surface of the fuser rollers, or if supplied to the end portions of the fuser roller where it is not removed by the paper, it can result in non-uniform swelling of the fuser roller surfaces with a detriment to paper handling as a consequence.

Similar concerns exist with respect to belt fusers in that unused oil on the end portions of the fuser belt can accumulate to quantities which may result in dripping oil, degraded copy quality and the like.

Accordingly, in order to overcome these difficulties an improved method for controlling the distribution of fuser oil on a fuser surface has been sought.

SUMMARY OF THE INVENTION

It has now been found that the useful life of a fuser roller having ends, a length greater than a central portion of the fuser roller, the central portion of the fuser roller having ends, and end portions of the fuser roller extending from the ends of the central portion of the fuser roller to the ends of the fuser roller, at least a portion of the fuser roller being coated during operation with a release agent by contact with a wick roller, the wick roller comprising a porous wick roller body having ends, a length greater than a central portion of the wick roller, the central portion of the wick roller having ends, a release agent supply line in fluid communication with a central cavity in the wick roller body, a release agent impermeable coating over lengths of the wick roller body between the ends of the wick roller and the ends of the central portion of the wick roller, a release agent transfer surface over the outside of the wick roller and the release agent impervious coating can be extended by a method comprising:

a) positioning at least one opening with the total opening area being equal to from about 0.7 to about 3.0 percent of the total outside area of the release agent impervious coating in the release agent impervious coating and in fluid communication with the wick roller body and the release agent transfer surface between the ends of the wick roller and the ends of the central portion of the wick roller; and, b) adjusting the quantity of release agent transferred to the end portions of the fuser roller to a selected amount.

The present invention further comprises an improvement in a method for extending the useful life of a fuser roller having ends, a length greater than a central portion of the fuser roller, the central portion of the fuser roller having ends, and end portions of the fuser roller extending from the ends of the central portion of the fuser roller to the ends of the fuser roller, at least a portion of the fuser roller being coated during operation with a release agent by contact with a wick roller, the wick roller comprising a porous wick roller body having ends, a length greater than a central portion of the wick roller, the central portion of the wick roller having ends. a release agent supply line in fluid communication with a central cavity in the wick roller body, a release agent impermeable coating over lengths of the wick roller body between the ends of the wick roller and the ends of the central portion of the wick roller, a release agent transfer surface over the outside of the wick roller and the release agent impervious coating, an improvement comprising positioning at least one opening with the total opening area being equal to from about 0.7 to about 3.0 percent of the total outside area of the release agent impervious coating in the release agent impermeable coating and in fluid communication with the wick roller body and the release agent transfer surface and adjusting the quantity of release agent transferred to the end portions of the fuser roller to a selected amount.

The invention further comprises an improved wick roller comprising a porous wick roller body having ends, a length greater than a central portion of the wick roller, the central portion having ends, a release agent supply line in fluid communication with a central cavity in the wick roller body, a release agent impermeable coating over lengths of the wick roller body between the ends of the wick roller and the ends of the central portion of the wick roller, and a release agent transfer surface over the outside of the wick roller and the release agent impervious coating, and at least one opening with the total opening area being equal to from about 0.7 to about 3.0 percent of the total outside area of the release agent impervious coating and in fluid communication with the wick roller body and release agent transfer surface between the ends of the wick roller and the ends of the central portion of the wick roller.

The invention further comprises a method for controlling the distribution of fuser oil across the width of a fuser belt the method comprising positioning a wick roller comprising a porous wick roller body having outer ends, a length greater than a central portion of the wick roller, the central portion of the wick roller having ends, a release agent supply line in fluid communication with a central cavity in the wick roller body, a release agent impermeable coating over lengths of the wick roller body between the outer ends of the wick roller and the ends of the central portion of the wick roller and a release agent transfer surface over the outside of the wick roller and the release agent impervious coating in interactive contact with the fuser surface; b) positioning at least one opening with the total opening area being equal to from about 0.7 to about 3.0 percent of the total outside area of the release agent impervious coating in the release agent impervious coating and in fluid communication with the wick roller body and the release agent transfer surface between the ends of the wick roller and the ends of the central portion of the wick roller and c) Adjusting the quantity of release agent transferred to the end portions of the fuser roller to a selected amount.

DESCRIPTION OF PREFERRED EMBODIMENTS

In the description of the Figures, the same numbers will be used throughout to refer to the same or similar components. Further components of the copying or image production machines with which the invention of the present invention is useful, have not been shown in any detail except to the extent necessary to show the present invention.

Figure 1:
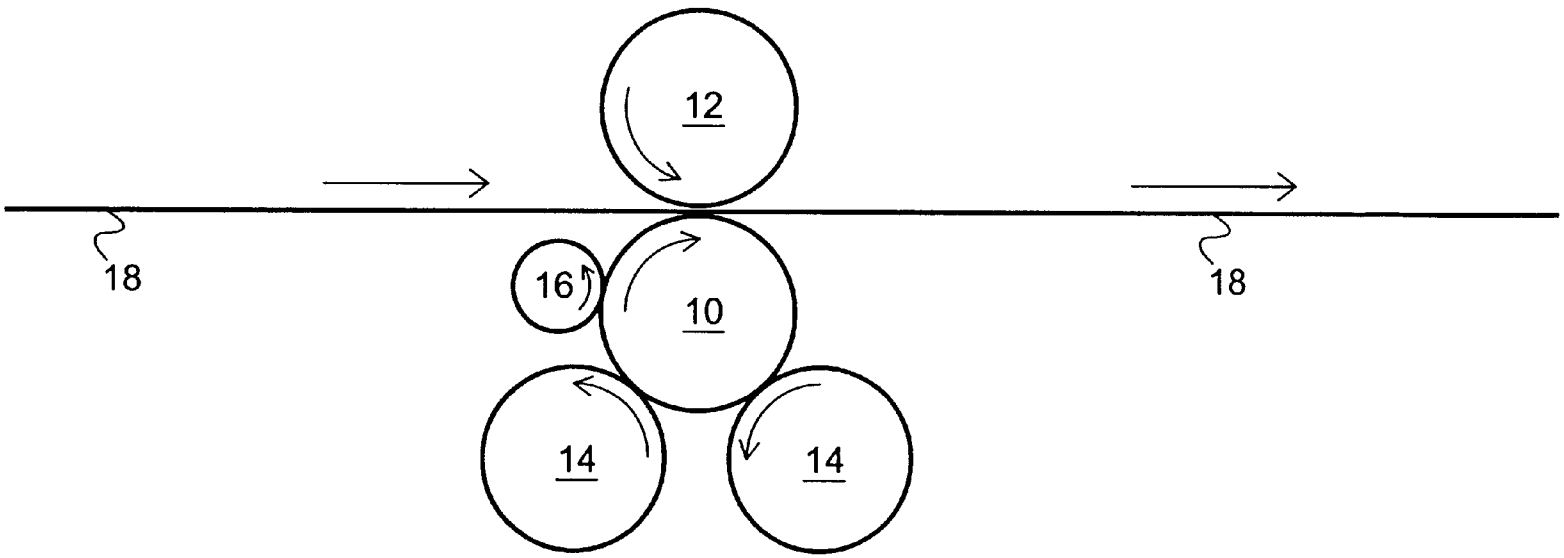
FIG. 1 PRIOR ART
FIG. 1 is a schematic diagram of a fuser roller in combination with a pressure roller, heater rollers and a wick roller for use in treating paper or other suitable media to fix, enhance or otherwise improve an image on the paper.

In FIG. 1 a fuser roller 10 is shown positioned to interact with a pressure roller 12 to process paper or other media (paper) passing along a paper flow path 18 to fix, improve or otherwise treat an image on the paper. Fuser roller 10 is positioned to interact with and is heated by heater rollers 14, which may be driven and may drive fuser roller 10 or may be driven by fuser roller 10. Typically the rollers are driven by pressure roller 12. A wick roller 16 is shown for interactive contact with fuser roller 10 to place a thin layer of a release agent (oil) on fuser roller 10 in operation. Wick roller 16 will be described in greater detail hereinafter. It should be noted that the embodiment shown is illustrative only and that the fuser roller could be internally heated as known to those skilled in the art. In such an embodiment, no heater rollers are required. A variety of combinations for supporting, heating and driving the pressure roller, fuser roller, wick roller and optionally heater rollers may be used. The operation of such fuser rollers, pressure rollers and heater rollers is well known to those skilled in the art and need not be discussed further.

Figure 2:
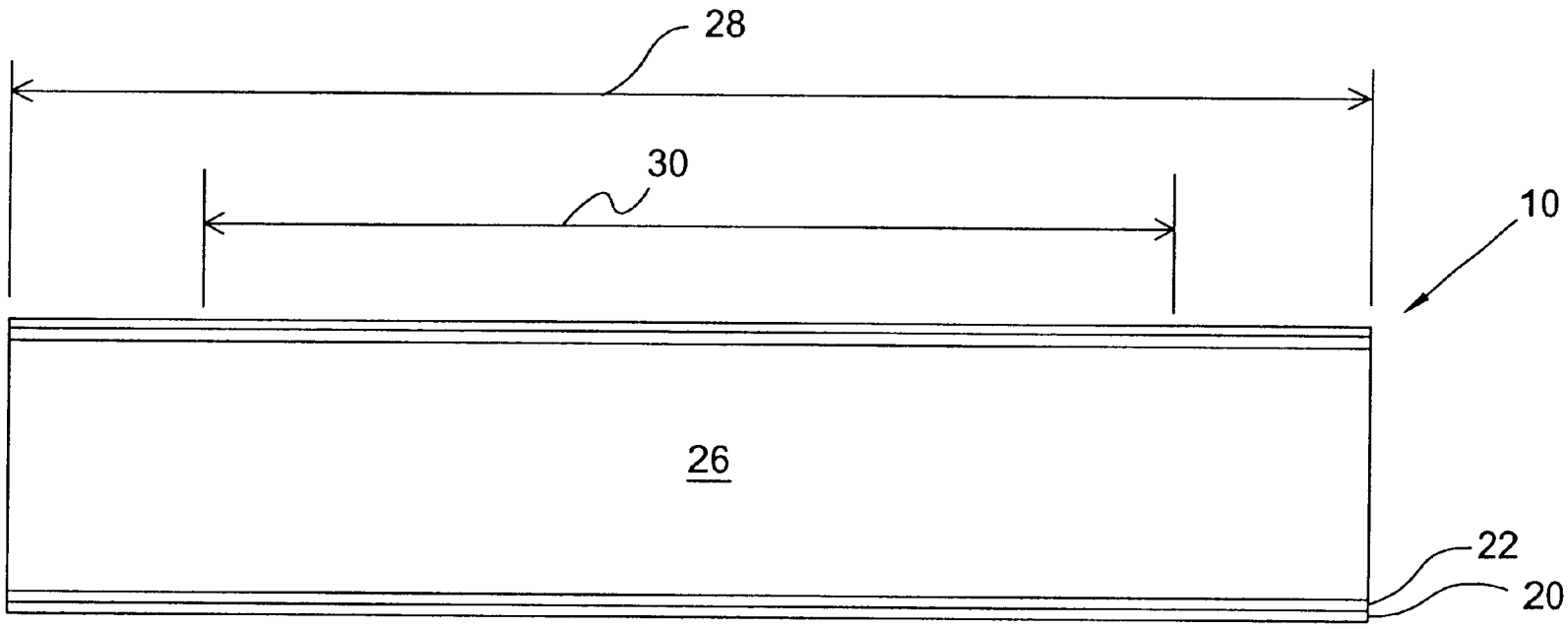
FIG. 2 PRIOR ART
FIG. 2 is a cross-sectional view of a fuser roller as known to the art.

A suitable fuser roller for use in conjunction with the present invention is shown in FIG. 2. The fuser roller 10 includes a fuser roller body 26, which may be of any suitable material, such as aluminum and includes a coating 20 of filled silicone rubber on its outer surface.

Fuser roller 10 is covered with filled silicone rubber 20 as known to those skilled in the art. Such filled silicone rubbers may contain quantities of conductive inorganic materials such as alumina in amounts up to about 45 volume percent or higher of the filled silicone rubbers to increase their heat capacity. Typically, these surface coatings are from about 0.002 to about 0.050 inches in thickness, and preferably from about 0.015 to about 0.020 inches in thickness. This coating has a relatively high heat capacity by comparison to unfilled or relatively unfilled silicone rubbers (up to about 48 weight percent inorganic filler) referred to herein as a non-filled insulating silicone rubber. The fuser roller further includes a coating 22 beneath filled silicone rubber coating 20 of a relatively unfilled, non-conductive, insulating silicone rubber. This layer is typically from about 0.10 to about 0.50 inches in thickness. Preferably, this layer is from about 0.150 to about 0.250 inches in thickness. While fuser roller 10 is shown as a fuser roller for external heating, it is noted that the fuser roller could be internally heated and if so, then the entire silicone rubber coating may comprise one or more layers of filled silicone rubber or a similarly conductive coating. Such coatings typically have a thickness from about 0.002 to about 0.50 inches, although the thickness is not critical so long as the desired contact and heat transfer properties are achieved. Whether fuser roller 10 is externally or internally heated, the entire coating may comprise a filled conductive material. Such variations are well known to those skilled in the art.

The fuser roller is typically about 15.5 inches in length as shown by line 28. Since the great majority of copying is on paper about 11 inches in width, the central portion 30 of the fuser roller is the most used portion of the fuser roller. While the entire surface is available, in many instances substantially all of the copying is done in the 11 inch central portion 30. As a result, the even application of release agent to the entire fuser roller can result in significant problems as previously discussed.

Figure 3:
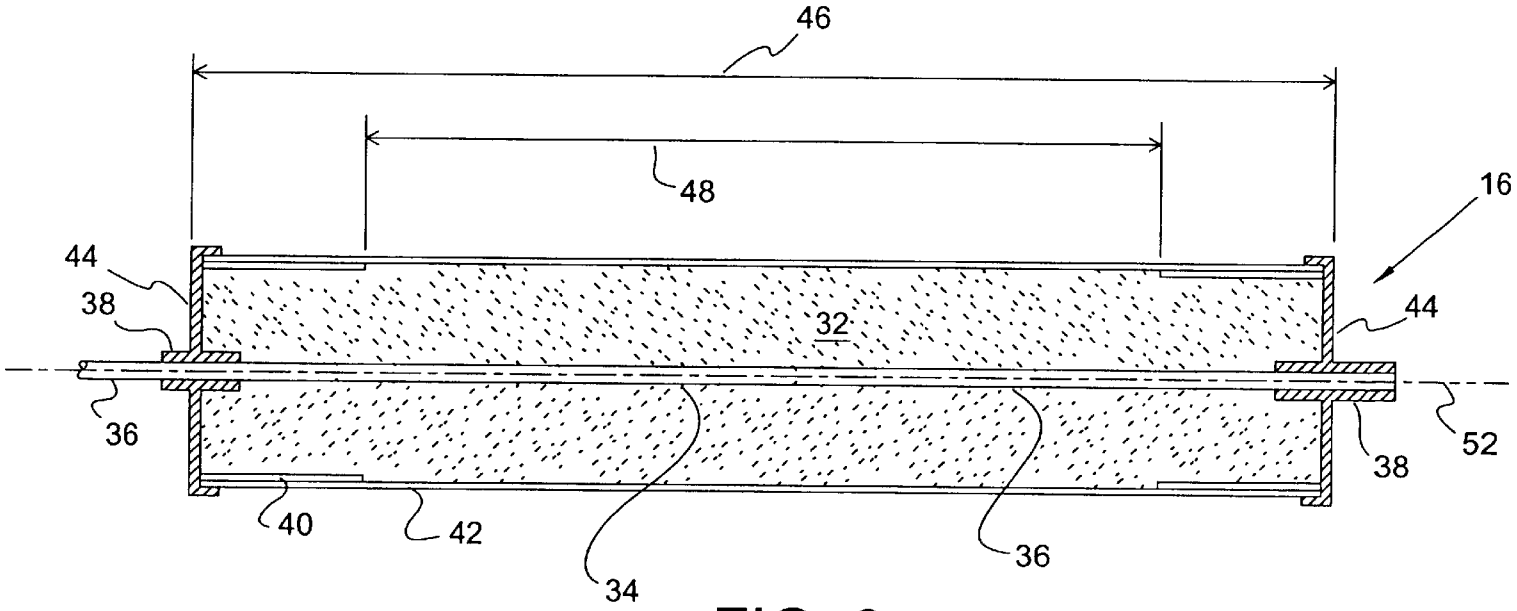
FIG. 3 is a cross-sectional view of a wick roller.

A release agent is applied to fuser roller 10 by a wick roller 16. A wick roller is shown in FIG. 3. Wick roller 16 comprises a wick roller body 32. which comprises a porous material which may be any suitably porous material which is stable at the temperature at the wick roller and which functions to permit oil to wick through the porous material as known to those skilled in the art as the wick roller rotates. One suitable material is porous alumina/silica carbide. Wick roller body 32 includes a cavity 34. An oil line 36 supplies oil to cavity 34 either directly or as a line, which may extend substantially through cavity 34 with perforations at selected intervals along the length of line 36 inside wick roller body 32. Such perforations are not shown but are positioned to uniformly distribute the oil across the length of wick roller body 32. Further oil line 36 includes a pump or other means (not shown) to regulate the rate of flow of oil to cavity 34. Desirably the release agent is supplied to cavity 34 in a quantity equal to from about 1 to about 3 microliters per copy processed by the fuser roll. Typical release agents are silicone oils which have viscosities from about 100 to about 100,000 centistokes and preferably from about 10,000 to about 80,000 centistokes at 70° F. and may include electrostatic control agents or other additives known to those skilled in the art to facilitate the release of toner from fuser roll 10. Preferably the amount of oil is from about 1 to about 3 microliters per copy. As shown, line 36 enters cavity 34 and extends through cavity 34. Wick roller body 32 is rotatable about release agent line 36 and is rotated on roller supports 38 shown at each end. It will be appreciated that wick roller 16 could be supported from either end as well as from both ends. Wick roller 16 has an overall length 46 approximately the same as fuser roller 10. Wick roller 26 also has a central portion 48, which is approximately the same as the central portion of fuser roller 10. To control the supply of oil to fuser roller 10, it is common practice to place an oil impervious coating 40 over the portions of wick roller body 32 between the ends of wick roller 16 and the ends of the central portion 48 of wick roller 16. This prevents the supplying of release agent to the end portions of fuser roller 10 outside its central portion 30. This prevents the accumulation of excessive release agent (oil) on the outer ends of release roller 10 and the like. An oil transfer surface 42 is positioned on the outer surface of roller 16 and coating 40 and in oil transferring contact with roller 10 and wick roller body 16. Typically end caps 44 are sealingly positioned over each end of roller 10.

As a result, little or no oil reaches the end portions of the fuser roller between the ends of the central portion 30 and the ends of fuser roller 10. This has been observed to result in non-uniform hardening, non-uniform shrinking and cracking of the ends of fuser roller 10. It is also well known that when too much oil is supplied to the ends of fuser roller 10 that the silicone coatings typically used on fuser roller 10 tend to non-uniformly swell and deform. Since either type of deformation is detrimental to paper handling and to the recycling of fuser roller 10, a solution to this problem has long been sought.

Figure 4:
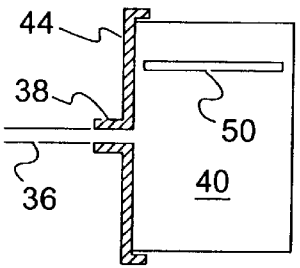
FIG. 4 is a cross-sectional view of a section of a wick roller showing an embodiment of the present invention; an FIG. 5 is a schematic diagram of a belt fuser system.

In FIG. 4 an end section of wick roller 16 is shown with one of the sections 40 of oil impervious coating. An opening wick slot 50.shown as a slot has been placed in this section to permit limited quantities of oil to be available for transfer to fuser roller 10 in the areas outside its central portion 30. While the opening is shown illustratively as a wick slot, the opening may comprise a plurality of openings of substantially any desired configuration and positioned to achieve a desired oil flow volume and distribution along end portions of the fuser roller. Desirably the total area of all the openings is from about 0.07 to about 3.0 percent of the total outside area of the oil impervious coating and preferably from about 0.07 to about 1.7 percent. While the openings may be of substantially any shape it is desirable that they be large enough to permit the flow of the oil, numerous enough to permit distribution to achieve the desired flow volume and small enough to permit control of the flow rate and distribution. Oil impervious coating 40 is placed around wick roller body 32 in the end areas shown prior to placing an oil transfer surface 42 over the entire length of wick roller 16. The oil transfer surface may be of any suitable material. One such suitable material is an aramid fiber material supplied under the trademark NOMEX by Dupont de Nemours & Company, 1007 Market Street, Wilmington, Del.

This material is a compliant felt material which is suitable for use at the temperatures at the fuser roller surface to transfer the oil passing through wick roller body 32 onto fuser roller 10. Similarly, the oil passing through opening 50 is passed to the surface of fuser roller 10 but in much more limited quantities. Upon observation of the amount of release agent transferred to fuser roller 10, the quantity may be adjusted. If shrinking, cracking and the like are observed, a wider slot or larger or more numerous openings may be used. If swelling is observed, the size and number of openings can be reduced. If slots are used as the opening a single slot placed parallel to a longitudinal axis 52 of wick roller 16 is preferred, but a plurality of such slots maybe used. The cumulative width (also referred to as the equivalent width) of the slots should be from about 0.020 to about 0.100 inches. Desirably the total or equivalent width of slot 50 or slots 50 is from about 0.020 to about 0.040 inches and the slot or slots extend along at least a major portion of a length of the release agent impervious coating 40. The slot or slots may be placed parallel to a longitudinal axis of wick roller 16 and extend from near ends 94 to near the ends of central portion 48 and along at least about 90 percent of the length of impervious coating 40. The slot length is preferably from about 70 to about 90 percent of the length of coating 40. Further the slot may be positioned in spiral, diagonal or other configurations in coating 40 so long as it extends over the desired length. A wide variety of configurations may be used so long as the slot area available for the release of oil is effective to release the desired quantity of oil. If other openings are used it is desirable that they be sized and positioned as required to achieve the desired flow volume and distribution.

The oil impervious coating may be any suitable material which is impervious to the oil used at the temperatures and pressures encountered. One suitable material is marketed under the trademark MAGNABOND by Crossfield Products Corporation, 2153 Sacramento Street, Los Angeles, Calif.

The materials used for the outside of fuser roller 10 are typically filled silicone rubber as known to those skilled in the art. Typically the surface of fuser roller 10 is heated to a temperature from about 330 to about 385° F. The use of the oil as discussed above is particularly effective with such silicone rubbers and will be useful with other materials, which absorb oils in similar applications. As mentioned above, the release agent is typically silicone oil having a viscosity between 100 and 100,000 centistokes at 70° F. A suitable oil is marketed under the trademark DC 200 by Dow Corning, Midland, Mich. A typical additive for use with such oils is marketed under the trademark SILWET by Union Carbide Corporation, Old Ridgebury Road, Danbury, Conn. Accordingly the method of the present invention extends the useful life of fuser rollers. This represents a significant reduction in the operating expense for copying and image producing equipment.

While many of the concerns addressed above are related to the extension of the life of the fuser roller the use of the improved wick roller of the present invention results in better distribution of the fuser oil along the length of the fuser roller and across the width of a fuser belt. In either instance the application of oil at a uniform rate across the entire width of the fuser surface can result in the build up of fuser oil on the unused end portions of the fuser surface to a level such that the oil may drip from the fuser end portions of the fuser surface to the floor or into contact with other components of the copier/duplicator machine to the detriment of operations and possibly to the extent that a puddle may be formed beneath the machine. Further the presence of this fuser oil on these end portions at the elevated temperatures encountered in fusing operation may result in the presence oil vapors in the copier/duplicator machine which is detrimental to the life of the corona chargers and the like. Further the presence of this accumulated oil on the external ends of the fuser surface may result in oily copies when wider copies are run and the like. The use of the improved wick roller of the present invention permits control of the accumulation of excess fuser oil on the ends of the fuser surface while at the same time providing a selected quantity of fuser oil to these so that they remain oil coated.

Figure 5:
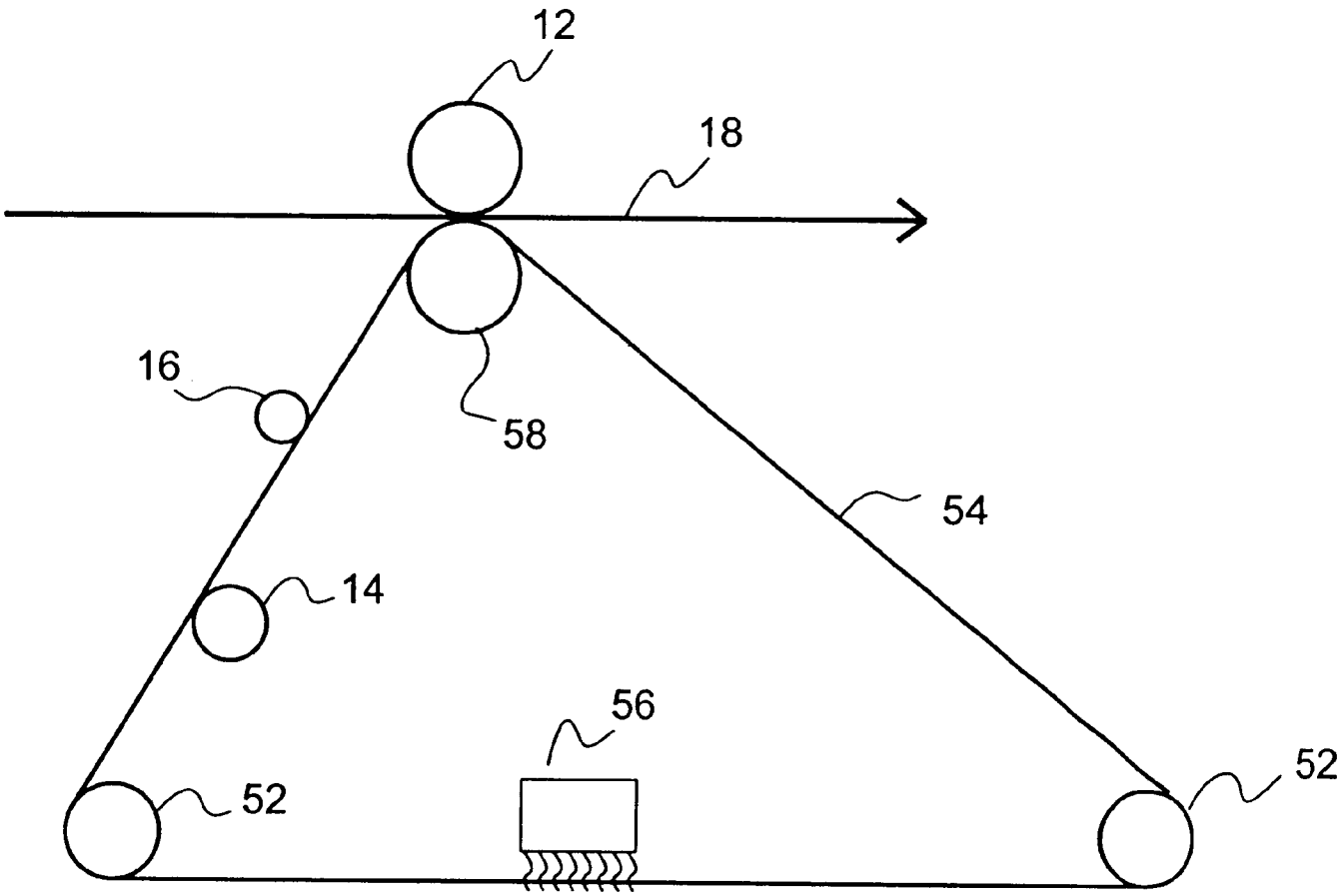

In this use of belt fusers such as shown schematically in FIG. 5 the fusing is accomplished at the nip between pressure roller 12 and a back up pressure roller 58. The paper passes along a path generally shown at 18. The paper is carried between pressure roller 12 and back up pressure roller 58 by a fuser belt 54 which may comprise metallic or polymeric materials. A fuser belt system is disclosed in U. S. Pat. No. 6,096,424 issued Aug. 1, 2000 to Chan et al. This patent is hereby incorporated in its entirety by reference. In the process shown in FIG. 5 the fuser belt 54 moves through a path between pressure roller 12 and back up pressure roller 58 into rollers 52. Fuser belt 54 may be heated by a radiant heater 56 or by a heater roller 14 or both. The improved wick roller 16 of the present invention is shown in position to oil the fuser belt prior to contact with the fuser belt with the paper. In such applications the fuser oil is desirably applied as discussed previously in the areas most frequently used for copying ie. the middle 11 inch portion of the fuser belt. The accumulation of the fuser oil on the outer ends of the fuser belt is undesirable. While unique improvements may be achieved with the filled silicone rubber on the fuser roller with respect to its life the additional improvements achieved by the use of the improvement of the wick roller of the present invention are realized with both the fuser roller system and the fuser belt system.

Having thus described the present invention by reference to certain of its preferred embodiments, it is respectfully pointed out that the embodiments described are illustrative rather than limiting in nature and that many variations and modifications are possible within the scope of the present invention.

Having thus described the invention, we hereby claim:

1. A method for extending the useful life of a fuser roller having ends, a length greater than a central portion of the fuser roller, the central portion of the fuser roller having ends, and end portions of the fuser roller extending from ends of the central portion of the fuser roller to the ends of the fuser roller, the fuser roller being coated during operation with a release agent by contact with a wick roller, the wick roller comprising a porous wick roller body having ends, a length greater than a central portion of the wick roller, the central portion of the wick roller having ends, a release agent supply line in fluid communication with a central cavity in the wick roller body, a release agent impervious coating over lengths of the wick roller body between the ends of the wick roller and the ends of the central portion of the wick roller, a release agent transfer surface over the outside of the wick roller and the release agent impervious coating, the method comprising:

a) positioning at least one opening with a total opening area being equal to from about 0.7 to about 3.0 percent of the total outside area of the release agent impervious coating in the release agent impervious coating and in fluid communication with the wick roller body and release agent transfer surface between the ends of the wick roller and the ends of the central portion of the wick roller; and, b) adjusting the quantity of release agent transferred to the end portions of the fuser roller to a selected amount.

2. The method of claim 1 wherein the fuser roller includes an outer coating comprising a filled silicone rubber.

3. The method of claim 2 wherein the outer coating is heated to a temperature from about 330 to about 385° F.

4. The method of claim 2 wherein the fuser roller includes an inner coating comprising a non-filled insulating silicone rubber.

5. The method of claim 4 wherein the quantity of release agent is a quantity sufficient to prevent hardening and shrinking of the outer coating or the inner coating, but insufficient to cause swelling of the outer coating or the inner coating.

6. The method of claim 5 wherein the quantity is from about 1 to about 20 microliters per copy treated by the fusing roller.

7. The method of claim 1 wherein the release agent is a silicone oil having a viscosity from about 100 to about 100,000 centistokes at 70° F.

8. The method of claim 1 wherein the slot is a single slot and has a width from about 0.020 to about 0.040 inches.

9. The method of claim 1 wherein the quantity of release agent is adjusted by using openings of different sizes.

10. The method of claim 1 wherein a plurality of slots are used, the slots having a cumulative width from about 0.020 to about 0.100 inches.

11. In a method for extending the useful life of a fuser roller having ends, a length greater than a central portion of the fuser roller, the central portion of the fuser roller having ends, and end portions of the fuser roller extending from ends of the central portion of the fuser roller to the ends of the fuser roller, at least a portion of the fuser roller being coated during operation with a release agent by contact with a wick roller, the wick roller comprising a porous wick roller body having ends, a length greater than a central portion of the wick roller, the central portion of the wick roller having ends, a release agent supply line in fluid communication with a central cavity in the wick roller body, a release agent impervious coating over lengths of the wick roller body between the ends of the wick roller and the ends of the central portion of the wick roller, a release agent transfer surface over the outside of the wick roller and the release agent impervious coating, an improvement comprising positioning at least one opening with a total area being from about 0.7 to about 3.0 percent of the total outside area of the release agent impervious coating in the release agent impervious coating and in fluid communication with the wick roller body and release agent transfer surface between the ends of the wick roller and the ends of the central portion of the wick roller, and adjusting the quantity of release agent transferred to the end portions of the fuser roller to a selected amount.

12. The improvement of claim 11 wherein the fuser roller includes an outer coating comprising a filled silicone rubber.

13. The improvement of claim 11 wherein the fuser roller includes an inner coating comprising a non-filled insulating silicone rubber.

14. The improvement of claim 11 wherein the outer coating is heated to a temperature from about 330 to about 385° F.

15. The improvement of claim 11 wherein the release agent is a silicone oil having a viscosity from about 100 to about 100,000 centistokes.

16. The improvement of claim 11 wherein the slot is a single slot and has a width from about 0.020 to about 0.040 inches.

17. The improvement of claim 11 wherein the quantity of release agent is a quantity sufficient to prevent hardening and shrinking of the outer coating or the inner coating, but insufficient to cause swelling of the outer coating or the inner coating.

18. The improvement of claim 17 wherein the quantity is from about 1 to about 20 microliters per copy treated by the fuser roller.

19. The improvement of claim 11 wherein the quantity of release agent is adjusted by using openings of different sizes.

20. The improvement of claim 11 wherein a plurality of slots are used, and the slots have a cumulative width from about 0.020 to about 0.100 inches.

21. A wick roller having ends and comprising a porous wick roller body having ends, a length greater than a central portion of the wick roller, the central portion of the wick roller having ends, a release agent supply line in fluid communication with a central cavity in the wick roller body, a release agent impervious coating over lengths of the wick roller body between the ends of the wick roller and the ends of the central portion of the wick roller, and a release agent transfer surface over the outside of the wick roller and the release agent impervious coating, and at least one slot opening with a total opening area being equal to from about 0.7 to about 3.0 percent of the total area of the release agent impervious coating in the release agent impervious coating and in fluid communication with the wick roller body and release agent transfer surface between the ends of the wick roller and the ends of the central portion of the wick roller.

22. The roller of claim 21 wherein the release agent supply line includes a valve for adjusting the flow of release agent into the central cavity to a selected quantity.

23. The roller of claim 21 wherein the slot is a single slot and has a width from about 0.020 to about 0.040 inches.

24. The roller of claim 21 wherein the release agent transfer surface comprises aramid fibers.

25. The roller of claim 21 wherein the roller includes end caps sealingly positioned over each end of the roller.

26. The roller of claim 21 wherein the quantity of release agent transferred to the end portions of the fuser roller is adjusted by using openings of different sizes to a selected amount.

* * * * *